United States Patent [19]

Kanady

[11] 4,043,348

[45] Aug. 23, 1977

[54] SMOKING PIPE TAMPER MEANS

[76] Inventor: Garland Harold Kanady, 201 Community Bldg., Ponca City, Okla. 74601

[21] Appl. No.: 604,160

[22] Filed: Aug. 13, 1975

[51] Int. Cl.[2] ..... A24F 3/02

[52] U.S. Cl. ..... 131/243; 131/247

[58] Field of Search ..... 131/247, 243, 177, 184 R, 131/184 A

[56] References Cited

U.S. PATENT DOCUMENTS

| | | | |
|---|---|---|---|
| 2,730,108 | 1/1956 | Hubbard | 131/247 |
| 3,263,690 | 8/1966 | Buckley | 131/243 |
| 3,269,396 | 8/1966 | Lamar | 131/247 |
| 3,777,766 | 12/1973 | Kanady | 131/247 X |

FOREIGN PATENT DOCUMENTS

| | | | |
|---|---|---|---|
| 733,499 | 7/1955 | Canada | 131/243 |

*Primary Examiner*—Stephen C. Pellegrino
*Attorney, Agent, or Firm*—F. Lindsey Scott; Glen M. Burdick

[57] ABSTRACT

An improved smoking pipe tamper means is provided wherein the tamper means is attached externally to any conventional lighter mechanism, said tamper means being adapted to slideably move between a first position wherein an enlarged tamper head means of the tamper means is contiguous to the exterior portion of the body member of said light mechanism and a second position wherein said enlarged tamper head means is spaced away from said light mechanism. In one embodiment the improved smoking pipe tamper means is adapted so that same can be interchangably placed upon a rectangular shaped lighter mechanism without damage to said tamper means or said lighter mechanism.

4 Claims, 11 Drawing Figures

SMOKING PIPE TAMPER MEANS

BACKGROUND OF THE INVENTION

1. Field of the Invention

This invention relates to smoking pipe tamper means. In one aspect the present invention relates to pipe tamper means in combination with a lighter mechanism. In another aspect the present invention relates to novel pipe tamper means which is attached to a lighter mechanism in a manner so that the tamper head of said tamper means can be caused to move between a first position wherein the tamper head of said tamper means is contiguous to the exterior portion of the body member of said lighter mechanism and a second position wherein said tamper head is spaced away from said lighter mechanism. In still another aspect, the present invention relates to a pipe tamper means which is readily interchangeable or rectangular shaped lighter mechanisms without damage to said lighter mechanism or said tamper means.

2. Brief Description of the Prior Art

Many types of accessories have been proposed to assist a person smoking a pipe. Many of these accessories have proved useful whereas many have possessed only novelty or curiosity benefits. However, as all pipe smokers can readily attest, a tamper means is an essential accessory if one is to enjoy the smoking of a pipe. Many different types of tamper means have been proposed by the prior art. However, most of these tamper means are separate instruments which must be carried in the pocket of the pipe smoker or in the tobacco pouch. In addition, one then needs to carry a lighter mechanism or matches for igniting the tobacco in the pipe bowl. Thus, it is readily apparent that the efficiency, accessability and convenience of accessories determine the degree of enjoyment derived from pipe smoking. In order to achieve this degree of enjoyment one has often been required to carry a number of accessories in his pockets or in a pouch to enable him to properly smoke the pipe and to maintain it in a lighted condition during the smoking period.

Further, many of the prior art tamper means have contained a tamper head which is a solid surface. Such a tamper means, while acting as an excellent tamper, has suffered from the disadvantage that many times the burning tobacco is snuffed out due to the blocking of oxygen from the lighted surface of the tobacco when such a tamper device is used. Thus, when employing such a solid surface tamper one must often relight the tobacco after each tamping process.

It is highly desirable that a tamper means be provided having a tamper head or surface which will allow a substantial amount of tobacco to be in contact with air for combustion during the tamping operation to prevent the extinguishing of the fire in the bowl of the pipe during such tamping operation. Such new and improved accessories for the pipe smoker are constantly being sought, especially ones which can serve a multiple purpose and eliminate the number of accessories or tools that a person must carry in order to enjoy the smoking of a pipe.

OBJECTS OF THE INVENTION

An object of the present invention is to provide an improved tamper means. Another object of the present invention is to provide an improved tamper means in combination with a lighter mechanism. Still another object of the present invention is to provide an improved tamper means in combination with a lighter mechanism wherein the tamper means can readily be employed to tamp the tobacco in a pipe bowl when desired and yet at the same time which will not protrude from the lighter mechanism when the tamper means is not in use.

Various other objects, advantages and features of the invention will become apparent to those skilled in the art from a reading of this disclosure.

BRIEF DESCRIPTION OF THE DRAWINGS

Drawings accompany and are a part of this disclosure. These drawings depict preferred specific embodiments of the tamper means of the invention, and it is to be understood that the drawings are not to unduly limit the scope of the invention. In the drawing.

Figure 1:
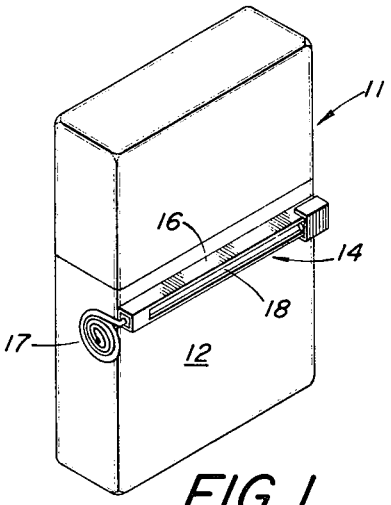
FIG. 1 is a perspective view of a lighter mechanism having an embodiment of the tamper means of the present invention.

In the following discussion and description of the invention reference will be made to the drawings wherein the same reference numerals will be used to indicate the same or similar parts and/or structure. The discussion and description is of specific embodiments of the tamper means of the invention, and it is to be understood that the discussion and description is not to unduly limit the scope of the invention.

DETAILED DESCRIPTION OF THE INVENTION

With reference to the drawing, and particularly to FIG. 1, lighter mechanism 11 is depicted having a case means 12 for containing a fuel supply and a flame producing igniter means. Tamper means 14 is secured to one face of said case means 12 by any suitable means such as welding, soldering, adhesives and the like.

Figure 2:
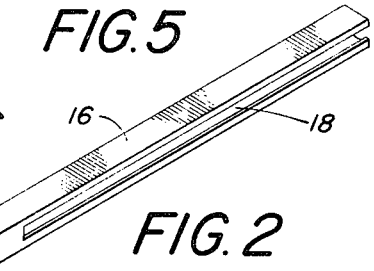
FIG. 2 is an enlarged perspective view of the housing means of the tamper means of FIG. 1.
Figure 3:
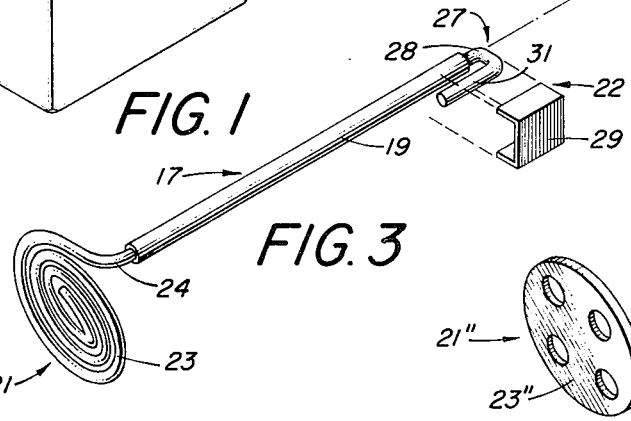
FIG. 3 is an enlarged perspective view of the slideable tamper member of the tamper means of the present invention.

Referring now to FIGS. 2 and 3, in conjunction with FIG. 1, tamper means 14 comprises tamper member 17 and elongated narrow hollow guide tube means 16, said guide tube means being adapted to slideably receive the elongated body means of tamper member 17. Guide tube means 16 is provided with a narrow longitudinal slot 18, said slot extending along a major portion of the length of guide tube means 16, preferably in the side portion removed from the side of said guide tube means which is secured to case means 12. Tamper member 17 is provided with an elongated body member 19, preferably a tubular member, having secured thereto at one end tamper head means 21 and at the other end thumb engageable means 22.

Tamper head means 21 is provided with tamper head member 23 and leg member 24. Head member 23 is constructed so as to be of a size adapted to fit into a pipe bowl. The plane of head member 23 is substantially perpendicular to leg member 24 and thus body member 19. When desired, tamper head member 23 and leg member 24 can be formed as a unitary member of an elongated heat resistant wire, said head member being a plurality of bends or spirals.

Figure 6:
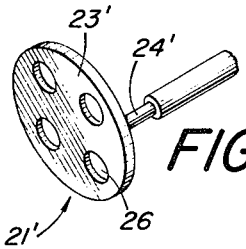
FIG. 6 is an enlarged perspective view of a second type of tamper head for the tamper means of the present invention.

Referring now to FIG. 6, a second type of tamper head means 21' is provided. In this embodiment tamper head means 21' is depicted as having tamper head member 23' and leg member 24'. Tamper head member 23' is formed of sheet metal or a heat resistant plastic material containing free flowing means 26 therein through which air can pass to the lighted tobacco during the tamping operation, thus preventing tamper head member 23' from snuffing out the burning tobacco. Leg member 24' is secured to one edge portion of tamper head member 23' by any suitable means such as welding, soldering, adhesives and the like. As previously stated, tamper head member 23' is secured to leg member 24' in such a manner that the plane of head member 23' is substantially perpendicular to the longitudinal axis of leg member 24'.

Referring again to FIGS. 1 and 3, thumb engageable means 22 is provided with a U-shaped body member 27, one leg portion 28 of said U-shaped member being inserted or affixed to the end portion of body member 19 removed from tamper head means 21. Such union can be made by any suitable means such as welding, soldering, or crimping. Body member 19 having said U-shaped member 27 attached thereto is then positioned within hollow guide tube means 16 so that U-shaped member 27 extends upwardly through slot 18 of said guide tube means. A plate or button means 29 is secured to second leg member 31 of U-shaped member 27 so that pressure can be applied to same to cause the desired movement of said tamper member.

Figure 5:
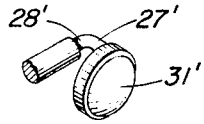
FIG. 5 is an enlarged perspective view of another type of thumb engageable means for the tamper means of the present invention.

Referring to FIG. 5, a second embodiment of the U-shaped body member 27' is depicted. In this embodiment leg member 28' is secured to one end portion of the body member of said tamper member, as previously described, and leg member 31' forms an enlarged area so that same can be employed as molding forms and support for the formation from thermoplastic resins of a button means. Further, as evident to those skilled in the art, the structure disclosed in FIG. 5 can be used, if desired, as the thumb-engageable means without modification of same.

Figure 4:
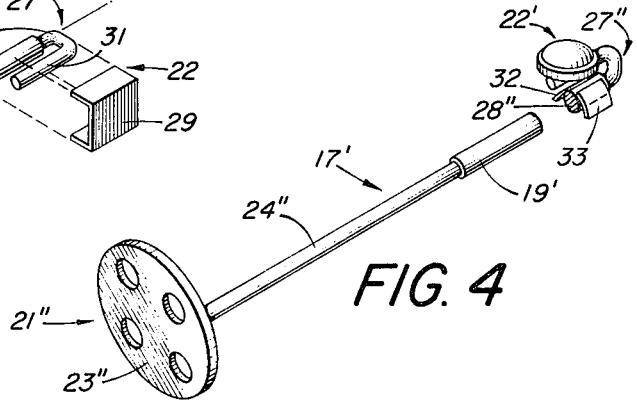
FIG. 4 is an enlarged perspective view of a second embodiment of the slideable tamper member of the tamper means of the present invention.

FIG. 4 illustrates another embodiment of the tamper member of the tamper means of the present invention. In this embodiment tamper member 17' is provided with a tubular body member 19' having secured thereto at one end tamper head means 21'' and at the other end thumb engageable means 22'.

Tamper head means 21'' is an elongated wire member having at a first end thereof a plurality of bends or spirals forming an enlarged area and the second end portion is adapted to be secured to one end portion of body member 19'. The plurality of bends and/or spirals forming the enlarged area of tamper head member 23'' is constructed so as to be of a size adapted to fit into a pipe bowl. The plane of head member 23'' is substantially perpendicular to leg member 24'' and thus tubular body member 19'. When desired, tamper head member 23'' and leg member 24'' can be formed of separate materials (see FIG. 6) and tamper head 23'' can be formed of sheet metal or a heat resistant plastic material containing free flowing means therein.

To the other end portion of body member 19' is secured thumb engageable means 22'. Thumb engageable means 22' is a U-shaped body member 27'' in which leg member 28'' of said U-shaped member is inserted or affixed to the end portion of body member 19' at the end removed from said tamper head means. Such union, as previously described, can be by any suitable means such as welding, soldering, or crimping. Body member 19' having leg member 28'' of said U-shaped member 27'' attached thereto is then positioned with the elongated narrow hollow guide tube means of said tamper means as previously described. Stabilizer means, such as flanges 32 and 33, each of a curved configuration, are secured to body member 19' at the end portion near the attachment of the thumb engageable means 22' and are positioned on said body member so that the outwardly extending end portions are caused to extend outwardly from body member 19' towards the interior of the hollow guide tube means in a direction away from the slot in said guide tube means. While the stabilizer means have been depicted as two separate plate members it should be understood that a single plate member could be employed, but when such single plate member is employed the point of attachment to the tubular body member would preferably be on the upper portion or lower portion of the body member with respect to the position of the body member within the guide tube means and the elongated slot therein.

Figure 7:
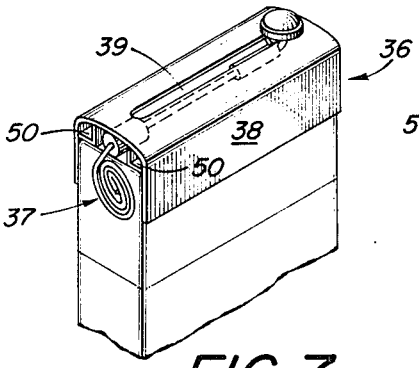
FIG. 7 is an enlarged partial perspective view of a lighter mechanism having another embodiment of the tamper means in accordance with the present invention.
Figure 8:
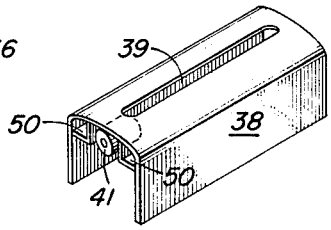
FIG. 8 is an enlarged perspective view of the housing means of the tamper means of FIG. 7.
Figure 9:
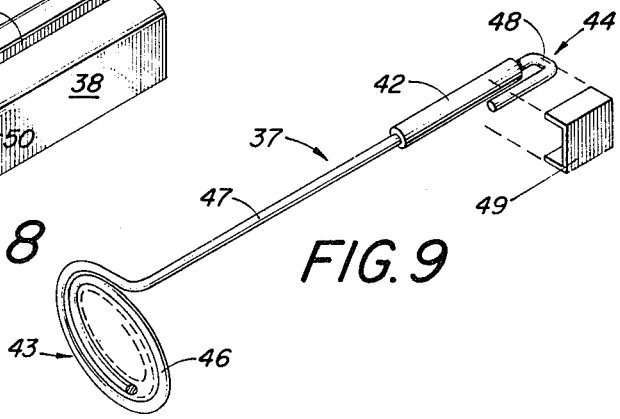
FIG. 9 is an enlarged perspective view of the slideable tamper member of the tamper means of FIG. 7.

Referring now to FIG. 7, 8 and 9, another embodiment of the tamper means of the present invention is disclosed. In this embodiment tamper means 36 comprises tamper member 37 and guide tube support means 38, said support means being adapted to slideably receive the body portion of tamper member 37. Guide tube support means 38 is depicted as a U-shaped elongated channel of resilient material adapted to frictionally engage the side walls of said channel with two opposed faces of a rectangular shaped lighter mechanism. Guide tube support means 28 is provided with a narrow longitudinal slot 39 which extends along a major portion of the length of the top face thereof. Hollow guide tube means 41 is aligned with said slot and secured to the inner surface of the upper face portion of guide tube support means 38 for slideably receiving elongated body member 42 of tamper member 37.

Tamper member 37 is provided with body member 42 having secured thereto at one end tamper head means 43 and at the other end thereof thumb engageable means 44. Tamper heads means 43 is provided with an enlarged tamper head member 46 and leg member 47. The plane of head member 46 being substantially perpendicular to the longitudinal axis of leg member 47 and thus body member 42. Tamper head member 46 and leg member 47 can be formed as a unitiary member of an elongated heat resistant wire, said head member being a plurality of bends or spirals. Tamper head means 43 can also be a multi-member unit comprising a tamper head member formed of a sheet metal or heat resistant plastic material having free flowing means therein and a leg member which is secured to one edge portion of the tamper head member by any suitable means such as welding, soldering, adhesives and the like.

Thumb engageable means 44 is preferably provided with a U-shaped body member 48, one leg of said U-shaped member being inserted or affixed to the end portion of body member 42 removed from said tamper head means. A plate or button means 49 can be secured to the remaining leg member of U-shaped body member so that pressure can be applied to same to cause the desired movement of said tamper member. Since guide tube support means 38 is constructed so as to be fitted upon a rectangular shaped lighter mechanism it may be desirable to provide support members 50 within the interior upper portion of said guide tube support means to insure that the support means is not compressed on the lighter mechanism case to a depth to interfere with the operation of the tamper means.

While guide tube means 41 has been depicted as extending in length only up to the elongated slot in said guide tube support means, it is to be understood that such guide tube means can be extended the length of said support means provided that the interior portion of said guide tube means is in open, unrestricted communication with the elongated slot in said support means.

Figure 10:
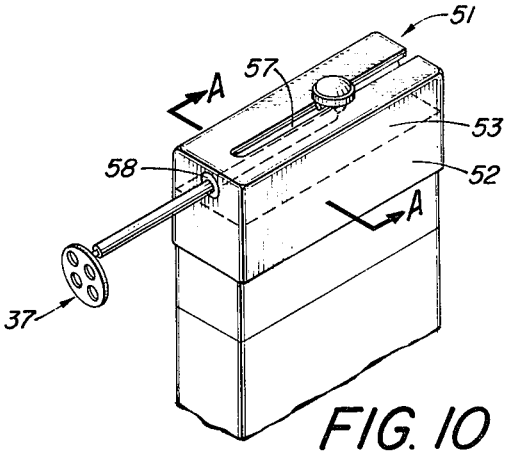
FIG. 10 is an enlarged perspective view of still another embodiment of the housing means of the tamper means of FIG. 7.
Figure 11:
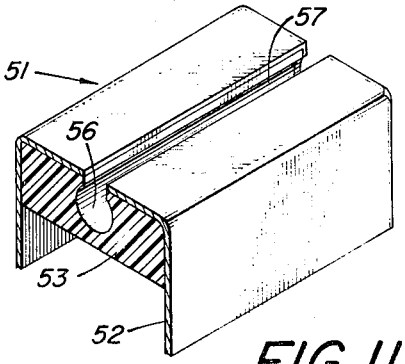
FIG. 11 is an enlarged partial perspective view of the housing means of FIG. 10.

Referring now to FIGS. 10 and 11 there is depicted another embodiment of the improved smoking pipe tamper means. Guide means 51 is of a generally rectangular box construction having one open side (lower portion) 52. Open side 52 is adapted to receive and frictionally engage one end of the case means of a lighter mechanism. The upper portion 53 of guides means 51 is provided with a narrow longitudinal slot 57, said slot extending along a major portion of the length of the side of said guide means opposite the open side. Guide tubes means 56 is also positioned within upper portion 53 of said guide means and is adjacent to one end of said slot 57. Guide tube means 56 extend throughout the length of guide means 51 and is in open communication with slot 57. Grommet means 58 is positioned within the end portion of guide tube means 56 to allow more control over the movement of tamper member 37 (See FIG. 9). The use of grommet means 58 is important since it is preferable that guide tube means 56 be of a larger diameter than slot 57.

Referring now to FIG. 9 in conjunction with FIGS. 10 and 11, tamper member 37 is provided with body member 42 having secured thereto at one end tamper head means 43 and at the other end thereof thumb engageable means 44. Body member 42 is slideably positioned within guide tube means 56 so that tamper head means is exterior. Said guide tube means and thus grommet means 58 and thumb engageable means 44 extends upwardly through slot 57.

When the upper portion 53 of guide means 51 is constructed with a thermoplastic resin, it is desirable to use a metal band, securely affixed to said upper portion as the open side, e.g. lower portion. When desired, a tubular member can be positioned within guide tube means 56 and thus employed as such. However, in such instances, an elongated opening communicating with slot 57 must be provided.

As previously discussed, tamper heads means 43 is provided with an enlarged tamper head member 46 and leg member 47, the plane of head member 46 being substantially perpendicular to the longitudinal axis of leg member 47 and thus body member 42. Tamper head member 46 and leg member 47 can be formed as a unitary member of an elongated heat resistant wire, said head member being a plurality of bends or spirals. Tamper head means 43 can also be a multi-member unit comprising a tamper head member formed of a sheet metal or heat resistant plastic material having free flowing means therein and a leg member which is secured to one edge portion of the tamper head member by any suitable means such as welding, soldering, and the like.

Thumb engageable means 44 is preferably provided with a U-shaped body member 48, one leg of said U-shaped member being inserted or affixed to the end portion of body member 42 removed from said tamper head means.

While the foregoing discussion and description has been made in connection with certain preferred specific embodiments of the improved pipe tamper means of the present invention, it is to be understood that minor variations can be made in the pipe tamper means without departing from the spirit of the invention. Thus, it is to be understood that the discussion and the description is only intended to illustrate and teach those skilled in the art how to practice the invention, and such is not to unduly limit the scope of the invention, which is defined in the claims set forth hereinafter.

Having thus described the invention, I claim:

1. An extendible pipe tamper for use with a rectangular lighter mechanism case, said pipe tamper comprising a. a guide means, said guide means comprising a generally rectangular box having one of its sides open, said open side being adapted to functionally mate with an end of said rectangular case;

b. a guide tube means longitudinally positioned through said rectangular box, said guide tube means being positioned near the side opposite the open side of said rectangular box;

c. a narrow longitudinal slot positioned on a side of said rectangular box, said slot being in open communication with said guide tube means from a first end of said rectangular box to near a second end of said rectangular box;

d. an elongated body means slideably positioned in said guide tube means;

e. a tamper head means positioned on a first end of said elongated body means; and, f. a thumb-engageable means positioned on a second end of said elongated body means and extending through said slot so that said tamper head means is extended by moving said thumb-engageable means toward said second end of said rectangular box and retracted by moving said thumb-engageable means toward said first end of said rectangular box.

2. The pipe tamper of claim 1 wherein said slot is positioned in said opposite side of said rectangular box.

3. The pipe tamper of claim 2 wherein said guide tube means has a diameter greater than the width of said slot.

4. The pipe tamper of claim 1 wherein a grommet means is positioned in said second end of said rectangular box in said guide tube means to aid in the movement of said body means.

* * * * *